US005078395A

United States Patent [19]

Thorne

[11] Patent Number: 5,078,395

[45] Date of Patent: Jan. 7, 1992

[54] AUTOMATIC FOOTBALL HOLDER

[76] Inventor: John M. Thorne, 15 Bransfield Rd., Greenville, S.C. 29615

[21] Appl. No.: 355,477

[22] Filed: May 23, 1989

[51] Int. Cl.[5] ..... A63B 67/00

[52] U.S. Cl. ..... 273/55 B

[58] Field of Search ..... 273/55 B

[56] References Cited

U.S. PATENT DOCUMENTS 4,424,969 1/1984 Dumas ..... 273/55 B
4,460,173 7/1984 Dumas ..... 273/55 B
4,511,141 4/1985 Dumas ..... 273/55 B
4,648,596 3/1987 Long ..... 273/55 B

*Primary Examiner*—Theatrice Brown
*Attorney, Agent, or Firm*—H. Jay Spiegel

[57] ABSTRACT

An improved automatic football holder is seen to include a base on which a football holding mechanism it rotatably mounted. The inventive holder is designed to hold a football slightly suspended above a ground surface in a fixed position by virtue of latching and timing structure. After a prescribed time has elapsed, the latching structure is released to allow spring biasing means to pivot the holder to a position where the football is placed on the ground surface ready to kick.

11 Claims, 6 Drawing Sheets

AUTOMATIC FOOTBALL HOLDER

BACKGROUND OF THE INVENTION

The present invention relates to an improved automatic football holder. In the prior art, football holding devices are known; however, no such device is known which includes all of the aspects and features of the present invention.

Applicant is aware of the following United States Patents, each of which discloses an automated football holder:

Dumas U.S. Pat. No. 4,424,969
Dumas U.S. Pat. No. 4,460,173
Dumas U.S. Pat. No. 4,511,141
Long U.S. Pat. No. 4,648,596

None of the devices taught in these patents in any way resembles the structure, function or intended operation of the present invention.

SUMMARY OF THE INVENTION

The present invention relates to an improved automatic football holder. The present invention includes the following interrelated aspects and features:

(a) In a first aspect, the inventive automatic football holder includes a heavy base designed to support the inventive device on a ground surface. The base includes a plurality of legs spaced apart from one another for stability.

(b) The base has an upstanding post upon which is rotatably mounted a ball holding mechanism. The ball holding mechanism includes a first fixed arm including an end with a concavity sized and configured to receive the tip of a football therein. The ball holding mechanism further includes second and third pivotable arms having side surfaces designed to fit on opposed sides of the football.

(c) The ball holding mechanism is interconnected with the base with a spring configured to cause rotation of the base in a predetermined direction. When the ball holding mechanism is rotated against the force of the spring, a latch may be engaged to hold the ball holding mechanism in a fixed position against the force of the spring.

(d) The above described latch includes one-half carried on the ball holding mechanism and another half carried on the base. The base further includes a timer mechanism including means to trip the latch after a predetermined period of time has elapsed.

(e) After the predetermined period of time has elapsed, and the latch is tripped, the force of the spring causes rotation of the ball holding mechanism to a position where a guide surface on the ball holding mechanism is aligned in such a manner that the ball holding mechanism drops a prescribed distance to cause movement of the second and third pivotable arms away from the sides of the football and place the tip of the football on the ground surface. In such position, the ball is ready to be kicked.

(f) The inventive automatic football holder may be used to simulate game conditions in that it may be locked in a position where the ball is out of sight of the kicker and after the timed period, the ball holding mechanism may be rotated to index the ball into view of the kicker, whereupon the second and third pivotable arms are pivoted upwardly, simulating movement of the hands of a holder. In this way, the inventive device may be used to simulate game kicking conditions.

As such, it is a first object of the present invention to provide an improved automatic football holder.

It is a further object of the present invention to provide such a device which simulates game conditions to allow one to practice place kicking.

It is a further object of the present invention to provide such a device including a pivoting ball holding mechanism designed to hold a football and pivot the football to a position where it may be kicked.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
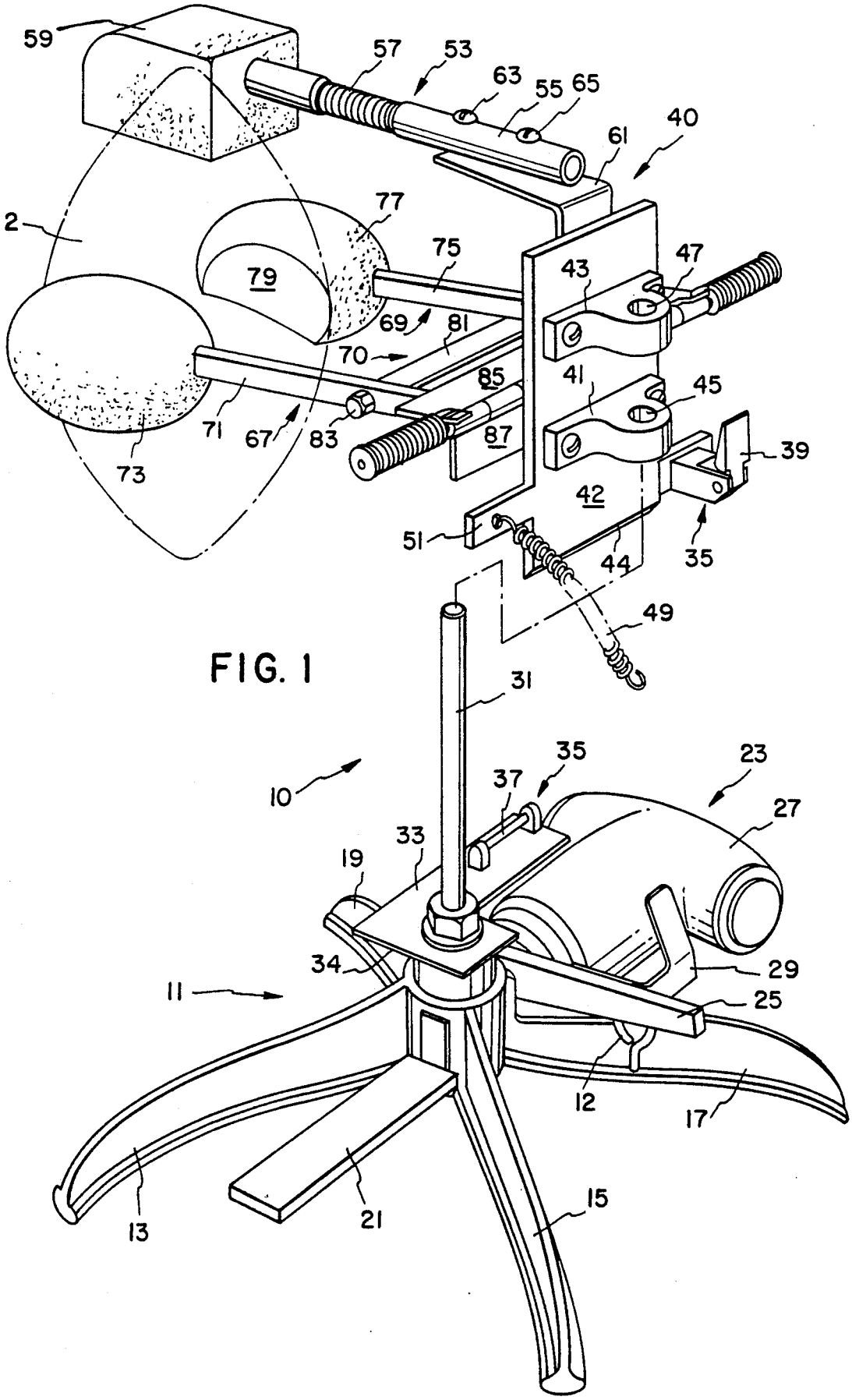
FIG. 1 shows an exploded perspective view of the present invention.

With reference, first, to FIG. 1, the inventive improved automatic football holder is generally designated by the reference numeral 10 and is seen to include a heavy base 11 having legs 13, 15, 17 and 19, as well as a rigid arm 21 provided for a purpose to be described in greater detail hereinafter.

The base 11 also has mounted thereon a timer mechanism 23 consisting of an arm 25 mounted on a shaft rotatably mounted within a chamber, 27 containing biasing means biasing the rotation of the arm 25 in the counterclockwise direction in the view of FIG. 1 and including damping fluid to damp the speed of rotation of the arm 25 so that when the arm 25 is pulled in the clockwise direction to the position shown in FIG. 1, it will then slowly rotate in a counterclockwise direction. As seen in FIG. 1, the arm 25 rigidly carries a lever 29 for a purpose to be described in greater detail hereinafter.

The base 11 further includes an upstanding post 31, as well as a guiding surface 33.

A latching mechanism 35 is contained on both the base 11 and the ball holding mechanism 40 with the catch 37 thereof being mounted on the guide surface 33 of the base 11, and with the latch 39 thereof being carried on the ball holding mechanism 40.

As should be understood from FIG. 1, the ball holding mechanism 40 includes two spaced guides 41, 43 with respective openings 45, 47 therethrough, which openings are designed to slidably fit over the post 31 of the base 11 so that the ball holding mechanism 40 may rotate with respect to the base 11 of the inventive automatic football holder 10.

A tension spring 49 is connected at one end to a tongue 51 on the ball holding mechanism 40, and on its other end to a ring 12 mounted on the leg 17, as shown in FIG. 1.

With further reference to FIG. 1, the ball holding mechanism 40 is seen to include a first arm 53 including a rod 55, a flexible adjustable portion 57 and a resilient ball engaging member 59. The first arm 53 is mounted on an L-shaped bracket 61 by suitable screws 63, 65.

Second and third arms 67, 69 are mounted on a frame 70 and are constrained to move together. The second arm 67 includes an elongated portion 71 and a resilient end 73 while the third arm 69 has an elongated portion 75 and a resilient end 77. The resilient ends 73 and 77 each have a concave surface, with the surface 79 of the end 77 being particularly shown in FIG. 1. These surfaces are configured to best facilitate engagement by the members 73 and 77 with the sides of a football designated by the reference numeral 2 in FIG. 1.

A rod 81 is attached between the elongated portions 71, 75 by structure including a bolt 83 and the elongated portions 71, 75 are rigidly fixed to a further member 85 which, in the preferred embodiment, is similar to one portion of a hinge mechanism, the other half of which is designated by the reference numeral 87 and is rigidly attached to the frame 42.

Figure 3:
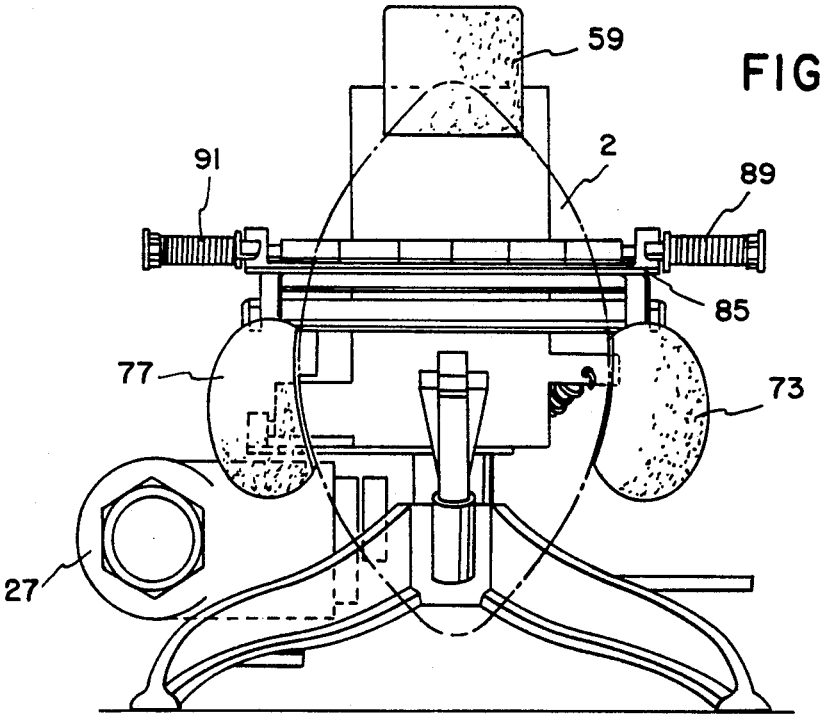
FIG. 3 shows a front view of the present invention.
Figure 5:
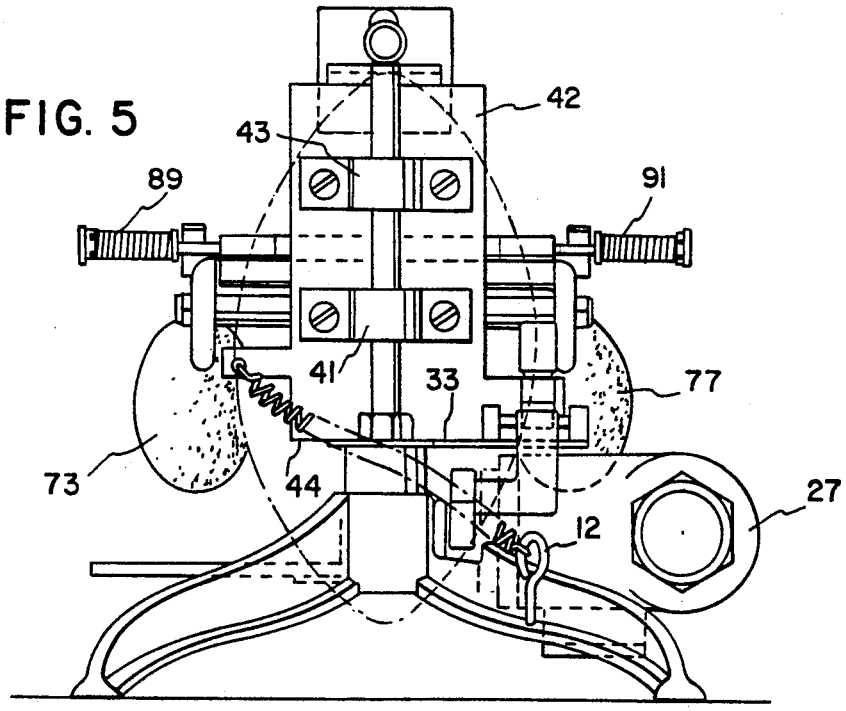
FIG. 5 shows a rear view of the present invention.
Figure 6:
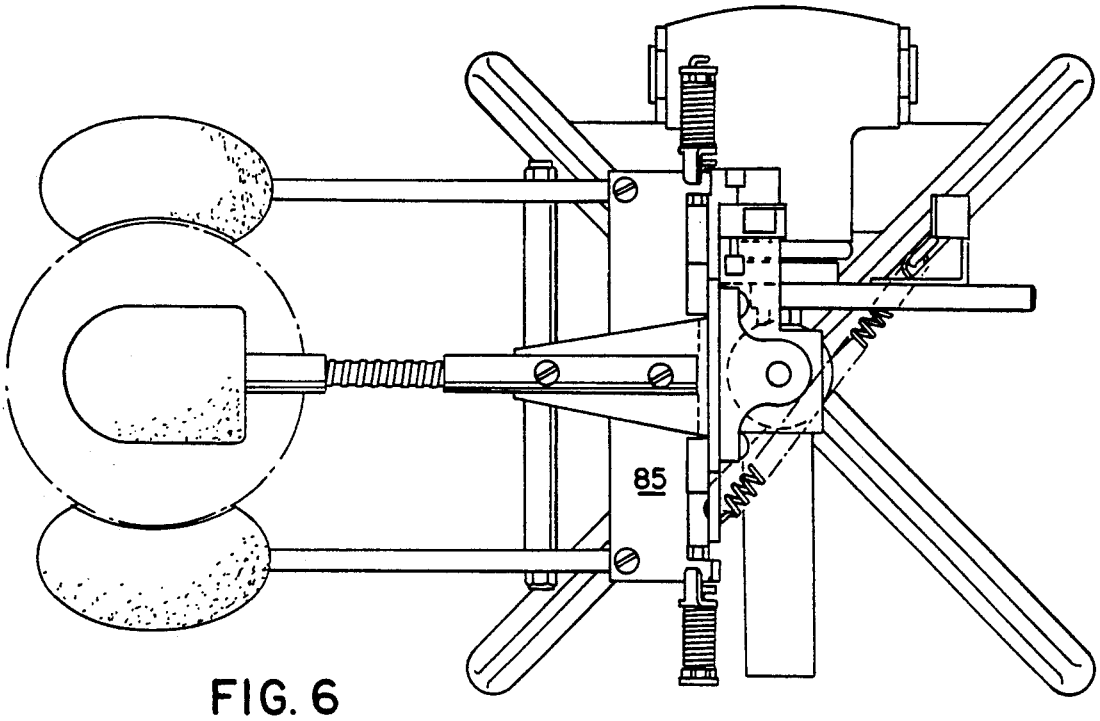
FIG. 6 shows a top view of the present invention in one orientation thereof.
Figure 9:
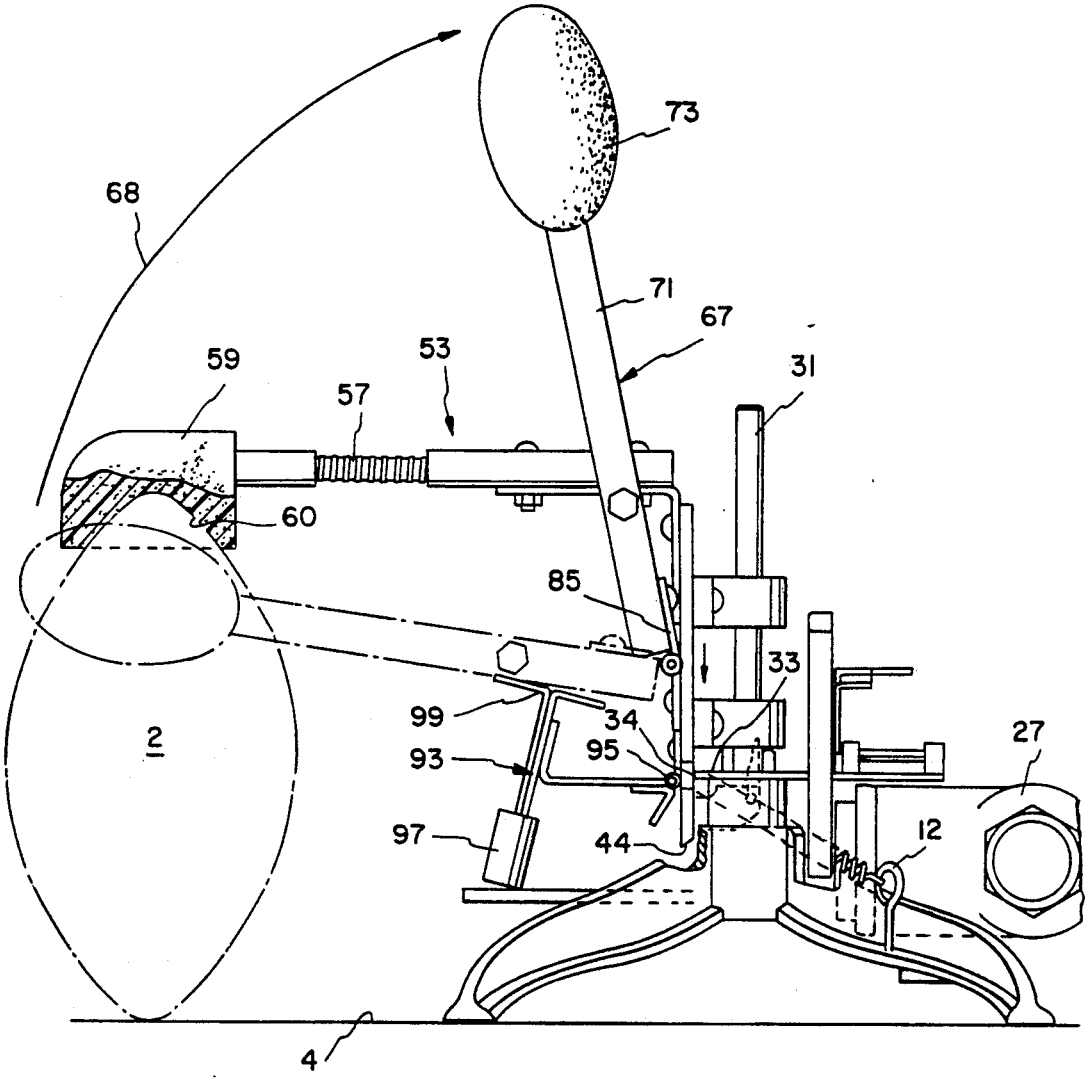
FIG. 9 shows a side view from a similar perspective as the view of FIG. 2, but with a different orientation of parts.

With particular reference to FIGS. 3 and 5, it is seen that the member 85 is interconnected with two tension springs 89 and 91 which bias the member 85 in the direction of rotation of the arms 67 69, as shown by the arrow 68 in FIG. 9.

Figure 2:
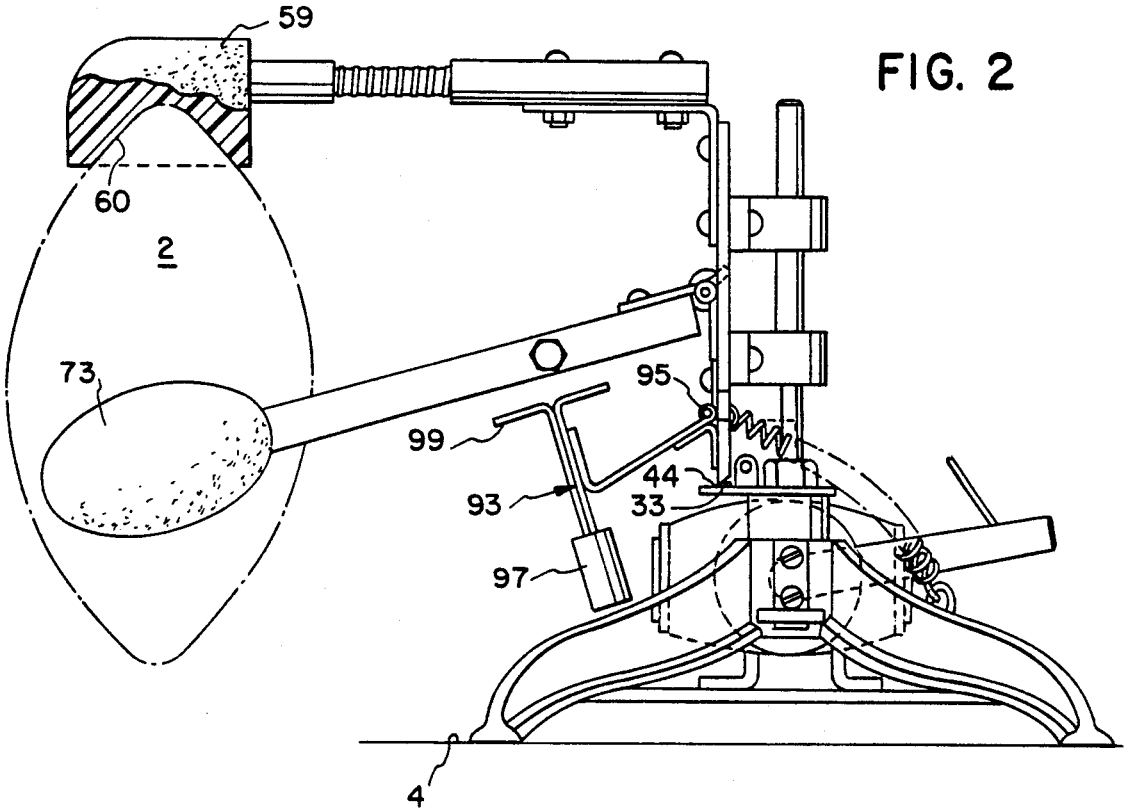
FIG. 2 shows a side view of the present invention.

With particular reference to FIGS. 2 and 9, it is seen that a stop member 93 is pivotably mounted at 95 to the frame 42 and includes a lower stop 97 and an upper stop 99 for a purpose to be described in greater detail hereinafter.

Figure 4:
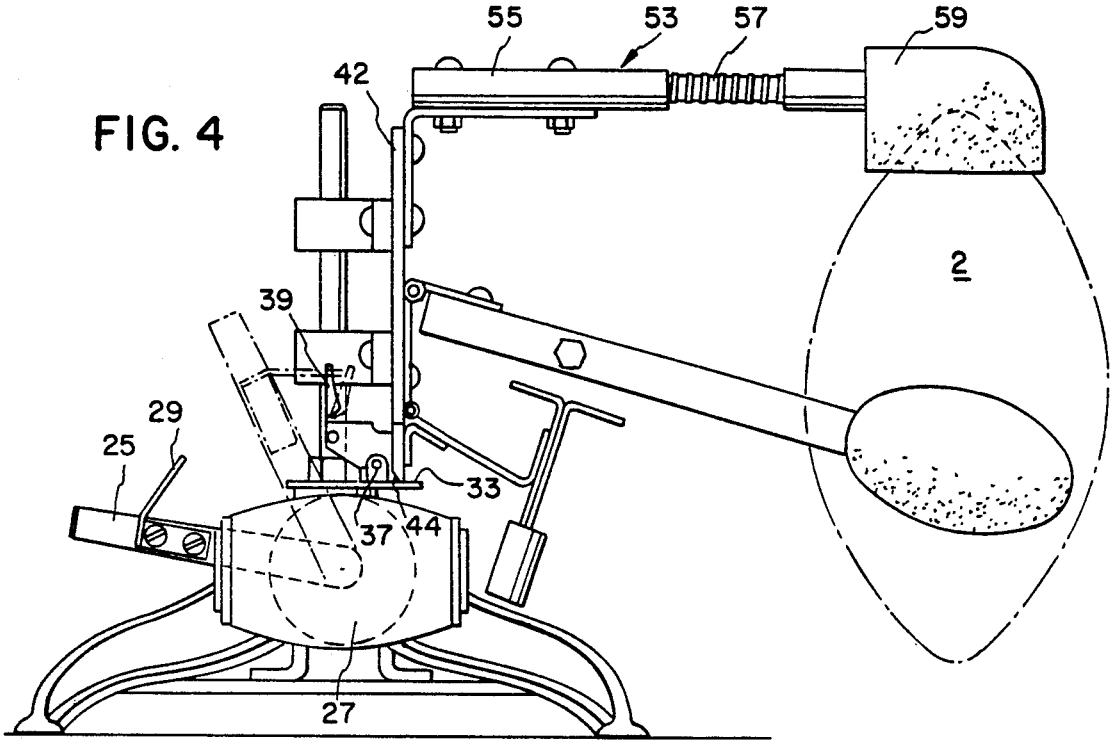
FIG. 4 shows a side view from the opposite side shown in FIG. 2.

With further reference to FIGS. 1 and 2, it is seen that the frame 42 has a bottom guiding edge 44 which, as seen in FIG. 2, is designed to rest on the guide surface 33 of the base 11 when the inventive automatic football holder 10 is in the position shown in FIG. 2 wherein the football 2 is suspended above the ground surface 4 and is held there by virtue of the arms 67, 69 gripping the sides of the football below the center thereof while the concave surface 60 of the member 59 of the arm 53 engages the tip of the football 2. In this position, the guide surface 33 supports the entirety of the ball holding mechanism 40 in such a manner that the ball 2 is suspended above the ground surface 4. Another view of this aspect is best seen in FIG. 3. FIG. 4 shows this same association of parts from a different direction, as does FIG. 5, as set forth in the Brief Description of the Drawings.

With the various components and structures of the present invention having been described in great detail, the preferred mode of operation of the present invention will now be described. As should be understood, with the ball holding mechanism 40 rotated to a position wherein the latch 35 is locked, the inventive device 10 is in the orientation of parts illustrated in FIGS. 2, 3, 4, 5 and 6. In this position, the surface 44 of the frame 42 is resting on the guide surface 33, the concave surface 60 of the element 59 has received therein a tip of the football 2 and the arms 67, 69 have been pivoted downwardly against the restoring force of the springs 89, 91 to firmly hold the football 2 suspended over the ground surface, as best seen in FIGS. 2–5. It should be understood that the arms 67, 69 are prevented form pivoting upwardly in the view of FIGS. 2–5 by virtue of the fact that the members 73, 77 are below the center of the football 2 and thus a wedging interaction takes place whereby the resilient elements 73, 77 would have to be resiliently pushed outwardly to allow them to pass by the center of the football to allow them to spring upwardly.

Figure 7:
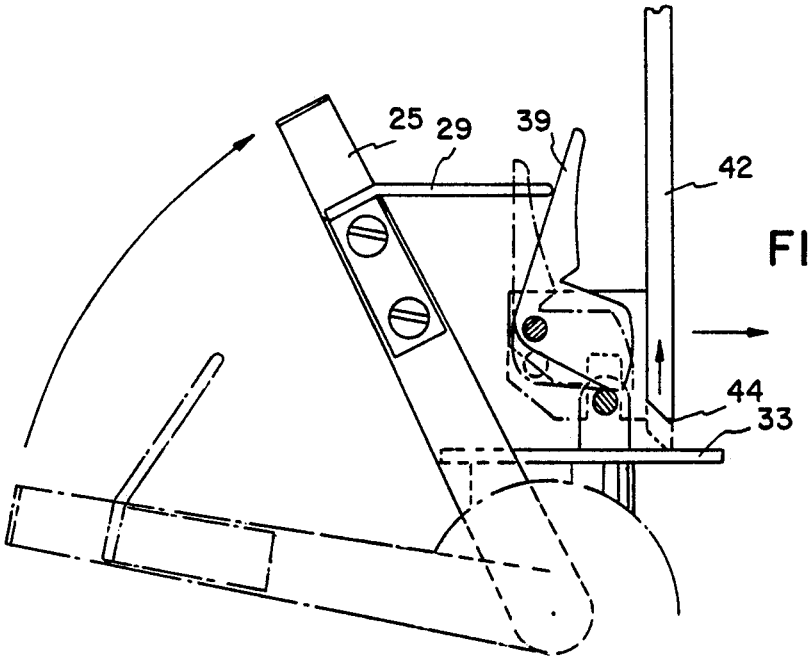
FIG. 7 shows a side view of the interaction of the timer mechanism and latching mechanism of the present invention.
Figure 8:
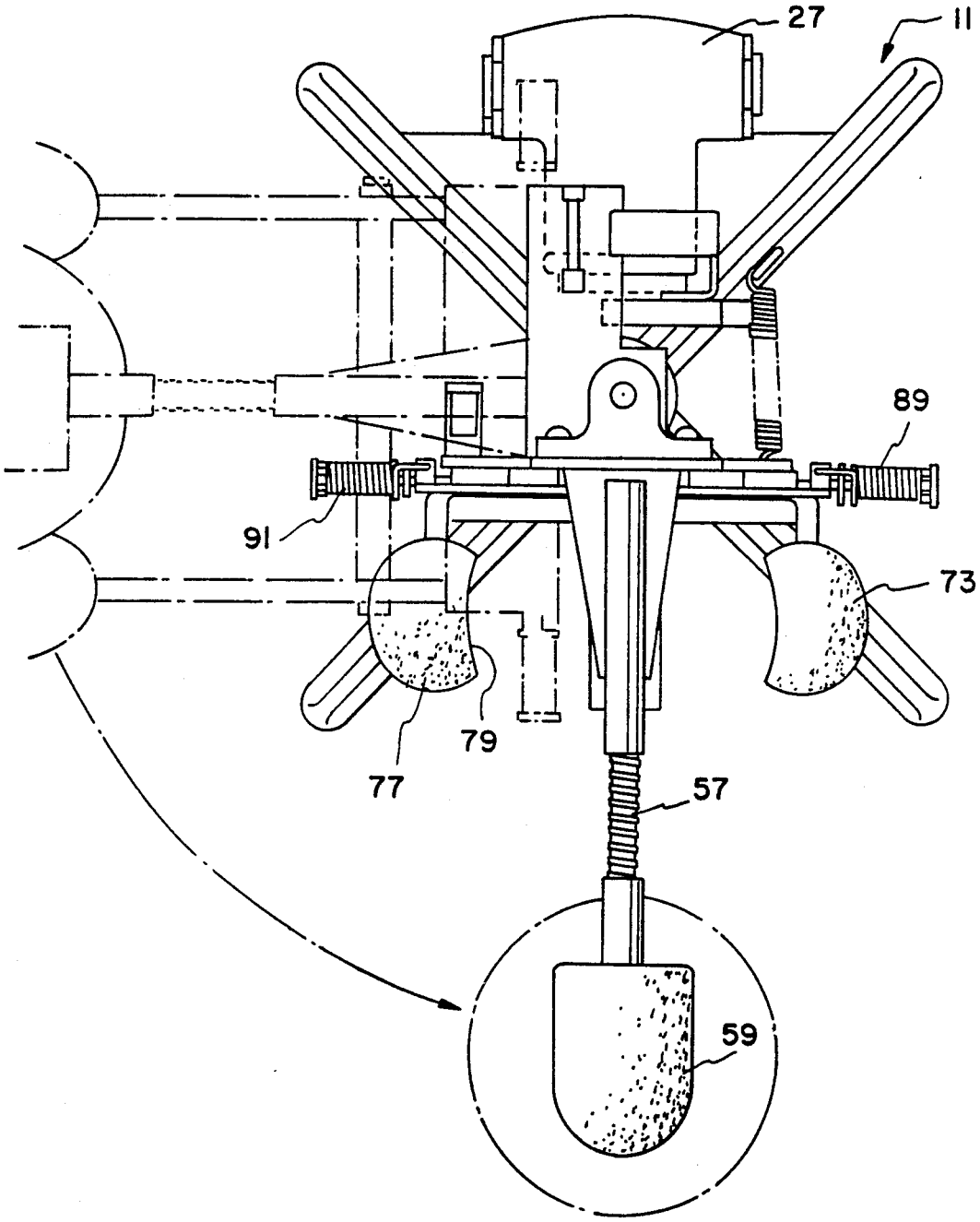
FIG. 8 shows a top view, but with a different orientation of parts from the view of FIG. 6.

In the position shown in FIGS. 2–6, the arm 25 of the timer mechanism 23 has been pivoted to the position shown in phantom in FIG. 7 to thereby allow the latch 35 to be securely closed, as best illustrated in FIG. 4 in the full lines.

Keeping in mind the view of FIGS. 2–6, when the timer mechanism 23 has operated to rotate the arm 25 a sufficient distance in the counterclockwise direction in the view of FIG. 1 (and in the clockwise direction in the view of FIG. 4) such that the member 29 engages the portion 39 of the latch 35 to pivot the portion 39 in a manner releasing it from the other portion 37 of the latch 35, a sequence of events substantially instantaneously occurs.

Firstly, the force of the spring 49 will cause rapid rotation of the entire ball holding mechanism 40 about the post 31 with these movements being guided by engagement of the edge 44 of the frame 42 on the guide surface 33. When the ball holding mechanism 40 has rotated to a position wherein the edge 44 of the frame 42 is parallel with the edge 34 (FIG. 1) of the guide surface 33, in such position, the edge 44 is outside the edge 34, thereby allowing the entirety of the ball holding mechanism 44 to drop downwardly with respect to the base 11.

It should be understood, that when the spring 49 has rotated the ball holding mechanism 40 to the above described position wherein the edge 44 is parallel with the edge 34, but spaced therefrom, at this same moment, the stop mechanism 93 (FIGS. 2 and 9) is aligned directly over the rigid arm 21 of the base 11 (FIGS. 1 and 9). Thus, it should be understood that as the ball holding mechanism 40 drops downwardly in this position, the lower stop 97 engages the rigid arm 21 while the upper stop 99 engages the crosspiece 81 rigidly interconnecting the arms 67 and 69. This interaction causes the members 73 and 77 to be forced upwardly and outwardly past the center of the football 2, whereupon the force of the springs 89, 91 will come into play to cause rapid pivoting of the arms 67, 69 to the full line position illustrated in FIG. 9. Simultaneously, the dropping of the ball holding mechanism 40 with respect to the base 11 will cause the bottom tip of the football 2 to engage the ground surface 4, as best illustrated in FIG. 9. FIG. 9 also shows the edge 44 and the guide surface 33 with its edge 34 in their relationship with the edges 34, 44 parallel to one another, but spaced from one another. Thus, in the position of the various components of the inventive football holder 10 illustrated in FIG. 9, the football 2 may easily be kicked.

When it is desired to set a football in the improved automatic football holder 10 from the position apart shown in FIG. 9, the ball holding mechanism 40 is lifted and rotated so that the edge 44 of the frame 42 is again resting on the guide surface 33. In this position, with the timer mechanism 23 arm 25 pulled back to the position shown in FIG. 1, the entirety of the ball holding mechanism 40 may be rotated until the latch 35 is engaged, as illustrated in FIG. 4. In this position, a football may be placed under the member 59 with the tip thereof in the concave recess 60 thereof. The arms 67, 69 may be pivoted downwardly until they engage the football below the center thereof and the kicker may position himself at the prescribed distance and location with respect to the spot at which the improved automatic football holder 10 will soon place the ball after the ball holding mechanism 40 thereof has rotated and then dropped to allow the arms 67, 69 to spring upwardly as indicated by the arrow 68 in FIG. 9.

Thus, the improved automatic football holder 10 as described hereinabove may be used to simulate actual game conditions wherein a holder catches a football from the center, rotates and puts the ball down on a spot on a ground surface. Such game condition actions may effectively be simulated by the present invention.

Of course, various modifications, alterations and changes in the teachings of the present invention may be contemplated by those skilled in the art. In this regard, the various component parts of the invention may be aesthetically changed to more closely resemble an actual human holder. Thus, if desired, a football helmet may be mounted above the device to simulate the head of the holder and the arm 53 may be designed to resemble the hand of the holder with one of the arms 67, 69 being designed to simulate the other hand thereof. Different team colors and uniforms could be represented in this manner.

Of course, the aspects set forth hereinabove are merely meant to demonstrate that various changes, modifications and alterations in the teachings of the present invention may be contemplated by those skilled in the art without departing from the intended spirit and scope of the present invention.

As such, it is intended that the present invention only be limited by the terms of the appended claims.

I claim:

1. An improved automatic football holder, comprising:

(a) a base adapted to sit on a ground surface and having a guide surface;

(b) a ball holding mechanism rotatably mounted on said base and including:

(1) guide means for guiding rotations of said ball holding mechanism on said guide surface between a first position and a second position rotatably transposed from said first position;

(2) biasing means for biasing said ball holding mechanism in a direction of rotative movement toward said second position;

(3) ball holding means for holding a football in an upright position;

(4) said ball holding means being adapted to hold a football suspended above said ground surface when said ball holding mechanism is in said first position, and when said ball holding mechanism is rotated to said second position by said biasing means, said ball holding means is adapted to hold a football with a first tip thereof remote from said ball holding means engaging said ground surface.

2. The invention of claim 1, further including latch means for releasably holding said ball holding mechanism in said first position.

3. The invention of claim 2, further including actuator means for releasing said latch means.

4. The invention of claim 3, further including timer means for controlling said actuator means, said timer means being adjustable to selectively choose a time period between a first time when said timer means is activated and a second time when said actuator means releases said latch means.

5. The invention of claim 4, wherein said timer means and actuator means are combined into a timer-actuator means including:

(a) a shaft rotatably mounted in a fluid filled motion retarding chamber;

(b) an actuator arm mounted on said shaft;

(c) said actuator arm comprising said actuator means and said chamber comprising said timer means.

6. The invention of claim 5, wherein said timer means further includes resilient biasing means for biasing said arm in a direction of release of said latch means, said motion retarding chamber retarding motion of said arm in said direction.

7. The invention of claim 1, wherein said guide means comprises an edge of a frame mounted on said base and carrying said ball holding means, said edge engaging said guide surface, and, whereby when said ball holding mechanism is rotated to said second position, said edge is disengaged from said guide surface thereby lowering said ball holding means with respect to said base and engaging said first tip of said football with said ground surface.

8. The invention of claim 7, wherein said first and second positions are spaced approximately 90 degrees apart.

9. The invention of claim 1, wherein said ball holding means comprises:

(a) a first arm adapted to engage a second tip of said football; and (b) second and third arms adapted to engage respective opposed side faces of said football.

10. The invention of claim 9, wherein said second and third arms are mounted together on a support pivotably mounted on said frame, and further including support biasing means for resiliently biasing said support in a direction of movement of said second and third arms away from said football, said second and third arms being adapted to be pivoted to a position engaging said football below a middle portion thereof.

11. The invention of claim 10, wherein actuator means for actuating said support is interposed between said support and said base, whereby with a football supported by said arms, when said ball holding means is rotated to said second position, said ball holding means is lowered to engage said first tip with said ground surface and said actuator means engages between said base and said support during lowering of said ball holding means to move said second and third arms upwardly above said middle portion of said ball whereby said support pivots under influence of said resilient bias away from said football.

* * * * *